US012508483B2

(12) United States Patent
Wu et al.

(10) Patent No.: US 12,508,483 B2
(45) Date of Patent: Dec. 30, 2025

(54) GOLF BAG SHOULDER STRAP SYSTEM

(71) Applicant: TUMI, INC., Edison, NJ (US)

(72) Inventors: Peter Chang-Lin Wu, Great Neck, NY (US); Victor G. Sanz, Whitehouse Station, NJ (US)

(73) Assignee: TUMI, INC., Edison, NJ (US)

( * ) Notice: Subject to any disclaimer, the term of this patent is extended or adjusted under 35 U.S.C. 154(b) by 214 days.

(21) Appl. No.: 18/140,831

(22) Filed: Apr. 28, 2023

(65) Prior Publication Data

US 2024/0359072 A1 Oct. 31, 2024

(51) Int. Cl.

| | |
|---|---|
| ***A45F 3/14*** | (2006.01) |
| ***A63B 55/00*** | (2015.01) |
| *A45F 3/00* | (2006.01) |

(52) U.S. Cl.

CPC ..... *A63B 55/408* (2015.10); *A45F 3/14* (2013.01); *A45F 2003/003* (2013.01); *A45F 2003/142* (2013.01)

(58) Field of Classification Search

CPC ..... A63B 55/408; A63B 55/00; A63B 55/50; A45F 3/04; A45F 3/14; A45F 3/047; A45F 2003/045

See application file for complete search history.

(56) References Cited

U.S. PATENT DOCUMENTS

| | | | |
|---|---|---|---|
| 5,988,475 | A | 11/1999 | Han |
| 6,328,192 | B1 | 12/2001 | Sundara et al. |
| 7,198,183 | B2 | 4/2007 | Yang |
| 8,657,168 | B2 | 2/2014 | Wear et al. |
| 2005/0145517 | A1 | 7/2005 | Yang |
| 2017/0120117 | A1 | 5/2017 | MacDonald |
| 2022/0088447 | A1 | 3/2022 | Shiao |

OTHER PUBLICATIONS

International Search Report for PCT application No. PCT/US24/26562 mailed on Aug. 14, 2024.

*Primary Examiner* — Corey N Skurdal
(74) *Attorney, Agent, or Firm* — Lando & Anastasi, LLP

(57) ABSTRACT

A golf bag strap support system includes a central hub having a hub body and two articulated strap connectors secured to the hub body. The system further includes two support straps, with each support strap having a first end and a second end. The system further includes two shoulder straps, with each shoulder strap having a first end and a second end. Each of the first ends of the support strap and the shoulder strap is secured to the golf bag. Each second end of the support strap is secured to the hub body (34) of the central portion. Each second end of the shoulder strap is secured to a strap connector of the two articulated strap connectors of the central hub. The two support straps and the two shoulder straps are configured with respect to the central hub in a generally X-shaped configuration.

21 Claims, 5 Drawing Sheets

GOLF BAG SHOULDER STRAP SYSTEM

FIELD OF THE INVENTION

The present disclosure is directed to golf bags, and more particularly to a shoulder strap system for carrying a golf bag.

BACKGROUND

Golf bags can be designed to be carried while playing golf. Modern day golf bags include shoulder straps that are designed to cause less stress on the user's shoulders, while balancing and eliminating bounce while walking with the golf bag.

SUMMARY OF THE INVENTION

One aspect of the present disclosure is directed to a golf bag strap support system for supporting a golf bag. In one embodiment, the strap support system comprises a central hub including a hub body and two articulated strap connectors secured to the hub body, and two support straps. Each support strap includes a first end and a second end. Each first end of the support strap is configured to be secured to the golf bag, Each second end of the support strap is secured to the hub body of the central portion. The strap support system further comprises two shoulder straps, with each shoulder strap including a first end and a second end. Each first end of the shoulder strap is configured to be secured to the golf bag. Each second end of the shoulder strap is secured to a strap connector of the two articulated strap connectors of the central hub. The two support straps and the two shoulder straps are configured with respect to the central hub in a generally X-shaped configuration.

Embodiments of the strap support system further may include securing the first end of each support strap to the golf bag at a middle of the golf bag, the first ends of the support straps being spaced from one another. The first end of each shoulder strap may be secured to the golf bag adjacent a top of the golf bag, the first ends of the shoulder straps being spaced from one another a distance similar to the spacing of the first ends of the support straps. The first end of each support strap may have a first part of a connector attached thereto for connecting with a second mating part of the connector attached to the golf bag. The first end of each shoulder strap may have a first part of a connector attached thereto for connecting with a second mating part of the connector attached to the golf bag. Each connector may be a releasable snap-fit connector. The second mating parts of the pivotal connectors may be disposed on the golf bag. Two second mating parts of the connectors may be disposed generally at a middle of the golf bag and two second mating parts of the connectors may be disposed towards a top of the golf bag. The second end of each shoulder strap may be stitched in a loop and secures a D-ring of the two articulated strap connectors. The hub body of the central hub may include a geometric shape having two pairs of opposing sides parallel to which the support straps and the strap rings and the shoulder straps are attached, respectively. The hub body of the central hub may be planar. Each shoulder strap may have a padded portion that engages the shoulder region of a carrier. Each shoulder strap may be stitched to the padded portion along the length of the padded portion in a daisy chain webbing technique to provide further adjustment of the length of the shoulder strap. The hub body of the central hub may include a frame portion and a padded portion secured to the frame portion. The central hub may be configured and arranged to be located generally in a center of a golfer's back when carrying the golf bag and the shoulder straps on both shoulders to provide for balance optimization on the back of the golfer when carrying the golf bag. The shoulder straps may be connected to the hub body of the central hub so that the shoulder straps are diagonally aligned with opposing support straps. The support straps may be attached to the hub body of the central hub at an angle, preferably 90 degree angle to each other. The support straps may be fixedly and permanently attached preferably to the hub body of the central hub at a fixed angle. The shoulder straps may be attached to the hub body of the central hub at an angle, preferably a nominal 90 degree angle to each other, each shoulder strap being pivotable about such a 90 degree angle. The support straps may be attached to the hub body of the central hub at a bottom of the hub body and the shoulder straps are attached to the hub body of the central hub at a top of the hub body.

A golf bag including the strap support system of embodiments of the present disclosure is further disclosed.

BRIEF DESCRIPTION OF THE DRAWINGS

Various aspects of at least one embodiment are discussed below with reference to the accompanying figures. The figures are provided for the purposes of illustration and explanation and are not intended as a definition of the limits of the invention. In the figures.

LIST OF REFERENCE NUMERALS UTILIZED IN THE DRAWINGS

Figure 1:
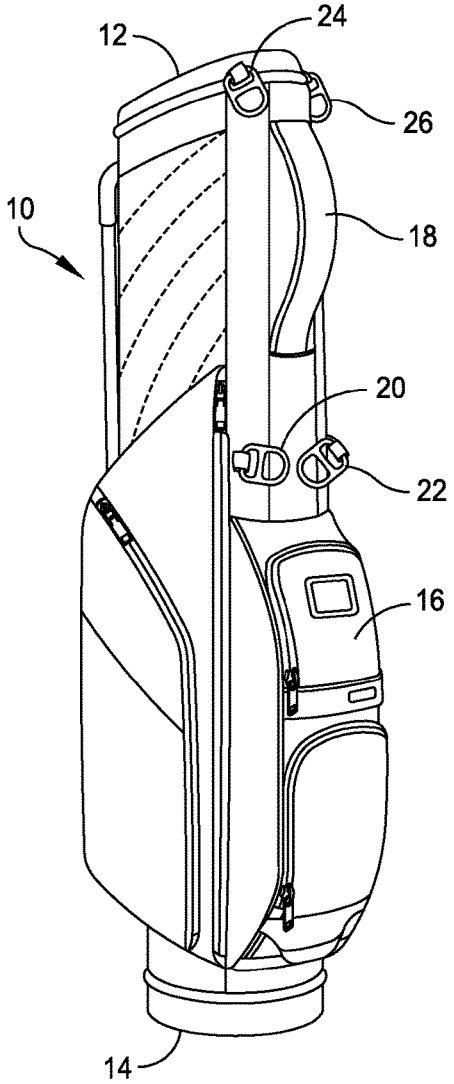
FIG. 1 is a perspective view of a golf bag.

With regard to reference numerals used, the following numbering is used throughout the description and drawings. Where technical features in the figures or detailed description are followed by these reference numerals, the reference numerals have been included for the sole purpose of increasing the intelligibility of the figures or detailed description. Accordingly, neither the reference numerals nor their absence is intended to have any limiting effect on the scope of any claim elements. In the figures, each identical or nearly identical component that is illustrated in various figures is represented by a like numeral. For purposes of clarity, not every component may be labeled in every figure.

Reference numeral 10 refers to a golf bag;

Reference numeral 12 refers to a top end of the golf bag;

Reference numeral 14 refers to a bottom end of the golf bag;
Reference numeral 16 refers to a pocket or compartment of the golf bag;
Reference numeral 18 refers to a handle of the golf bag;
Reference numeral 20 refers to a connector of the golf bag;
Reference numeral 22 refers to a connector of the golf bag;
Reference numeral 24 refers to a connector of the golf bag;
Reference numeral 26 refers to a connector of the golf bag;
Reference numeral 30 refers to a shoulder strap system;
Reference numeral 32 refers to a central hub of the shoulder strap system;
Reference numeral 34 refers to a hub body of the central hub;
Reference numeral 36 refers to a first support strap of the shoulder strap system;
Reference numeral 38 refers to a second support strap of the shoulder strap system;
Reference numeral 40 refers to a connector associated with support strap 36;
Reference numeral 42 refers to a connector associated with support strap 38;
Reference numeral 44 refers to an adjustable slide associated with support strap 36;
Reference numeral 46 refers to an adjustable slide associated with support strap 38;
Reference numeral 48 refers to a first D-ring of the central hub;
Reference numeral 50 refers to a second D-ring of the central hub;
Reference numeral 52 refers to a first shoulder strap of the shoulder strap system;
Reference numeral 54 refers to a second shoulder strap of the shoulder strap system;
Reference numeral 56 refers to a connector associated with shoulder strap 52;
Reference numeral 58 refers to a connector associated with shoulder strap 54;
Reference numeral 60 refers to an adjustable slide associated with shoulder strap 52;
Reference numeral 62 refers to an adjustable slide associated with shoulder strap 54;
Reference numeral 64 refers to a shoulder pad associated with shoulder strap 52;
Reference numeral 66 refers to a shoulder pad associated with shoulder strap 54;
Reference numeral 68 refers to a daisy chain technique for securing the shoulder strap to the shoulder pad;
Reference numeral 70 refers to a first pocket of the hub body;
Reference numeral 72 refers to a second pocket of the hub body;
Reference numeral 74 refers to an outer frame of the hub body;
Reference numeral 76 refers to a padded inner portion of the hub body; and
Reference numeral 100 refers to a person.

DETAILED DESCRIPTION

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as may be included within the spirit and scope of the described embodiments as disclosed. It is appreciated that any of the features of any of the embodiments can be used with any of the aspects and embodiments and it is understood that they can so be combined in any manner.

Embodiments of the present disclosure are directed to a shoulder strap system for a golf bag enabling a golfer to carry the golf bag with a single strap or with two straps. In one embodiment, the shoulder strap system includes a central pad or disk having two upper fixed strap connections and two lower pivoting strap connections with corresponding but opposite fixed and pivoting connections at the opposite ends, which are secured to the golf bag.

Referring to the drawings, and more particularly to FIG. 1, a golf bag of an exemplary and non-limiting design is generally indicated at 10. In the shown embodiment, the golf bag 10 includes an enclosure having an open top end 12 configured to receive shafts of golf clubs, a closed bottom end 14, and several compartments or pockets, e.g., pocket 16, having zippers to store items in the compartments. The golf bag 10 further can include a stand mechanism (not shown) having legs that enable the golf bag to be placed in an upright position. The golf bag 10 further includes a variety of straps, handles, e.g., handle 18, to enable the golf bag to be picked up and carried by its owner or caddie.

As shown, the golf bag 10 further includes shoulder strap connectors, two lower connectors 20, 22 provided at proximate the mid-point of the golf bag and two upper connectors 24, 26 provided proximate the top end 12 of the golf bag. The purpose of the connectors 20, 22, 24, 26 will be described as the description of the golf bag 10 and the shoulder strap system proceeds. In one embodiment, each connector 20, 22, 24, 26 can embody a snap-fit connector, such as a side release buckle, for easy connection with mating connectors of the shoulder strap system to the golf bag. Each connector 20, 22, 24, 26 is suitably connected or secured to the golf bag 10 by a small strap, such as a webbing strap that is rugged in construction. The small strap enables the connector 20, 22, 24, 26 to pivot with respect to a surface of the golf bag 10.

Figure 2:
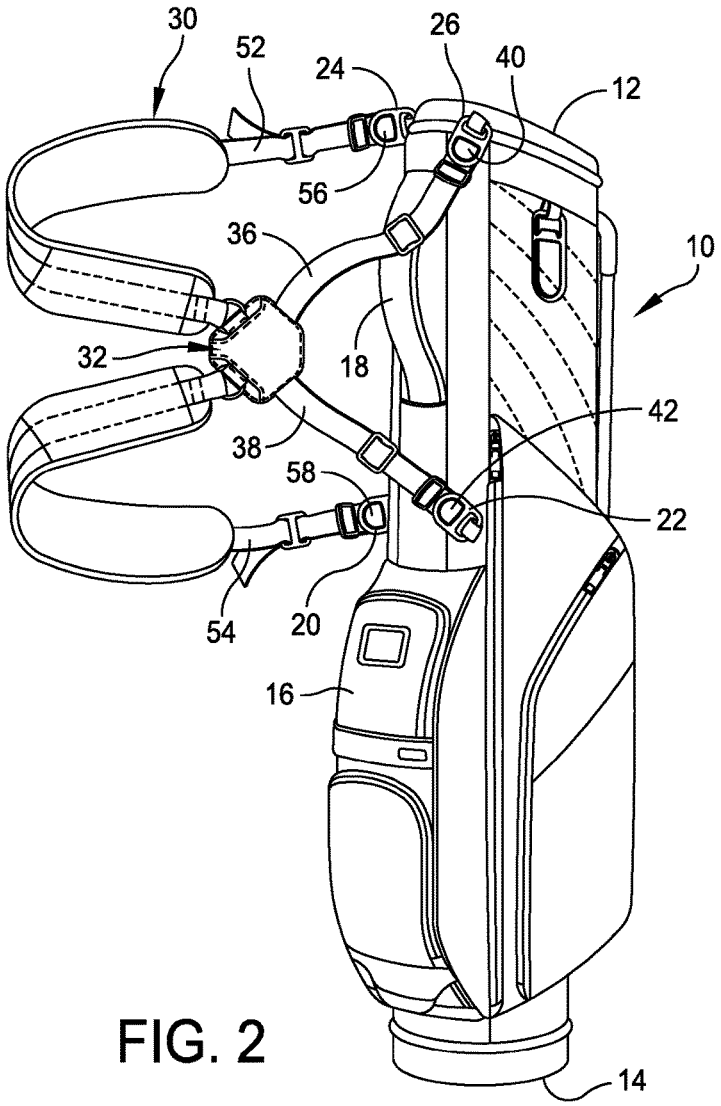
FIG. 2 is a perspective view of the golf bag having a shoulder strap system of an embodiment of the present invention.

Referring additionally to FIG. 2, the golf bag 10 further includes a shoulder strap system, generally indicated at 30, connected to the connectors 20, 22, 24, 26 of the golf bag. As shown, two connectors 20, 22 are located at a middle of the golf bag 10 and are spaced apart from one another. The other two connectors 24, 26 are located adjacent a top of the golf bag 10 and are spaced apart from one another a distance similar to the space between connectors 20, 22. As will be described in greater detail below, the shoulder strap system 30 includes several flexible straps that can be adjusted to fit the user of the golf bag 10. The shoulder strap system 30 is configured to enable the carrier to utilize two shoulder straps to carry the golf bag 10 generally over the back of the carrier and to enable the carrier to utilize one shoulder strap to carry the golf bag generally to the side of the carrier.

Figure 3:
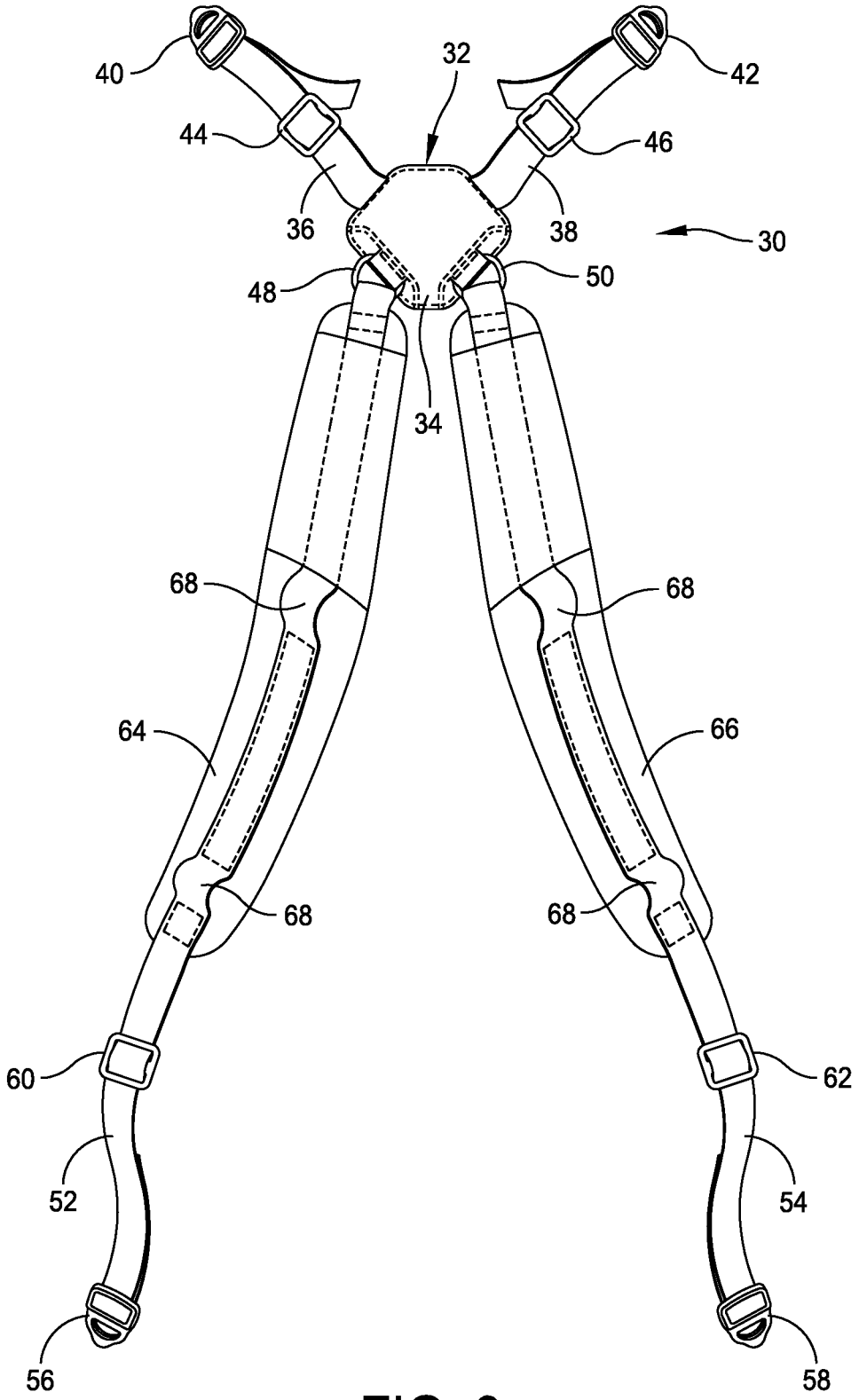
FIG. 3 is a is a front view showing the shoulder strap system.

Referring to FIG. 3, the shoulder strap system 30 is shown disassociated from the golf bag 10. As shown, the shoulder strap system 30 includes a central hub, generally indicated at 32, having a geometrically-shaped hub body 34. As shown, the hub body 34 has five sides, but can embody any number of sides and shapes. For example, the hub body 34 can be generally circular or oval. The shape of the hub body 34 of the central hub 32 is configured to secure straps and to position the straps in a generally X-shaped configuration.

The shoulder strap system 30 further includes two adjustable support straps 36, 38, which are secured to the hub body 34 of the central hub 32. In the shown embodiment, each support strap 36, 38 includes an end that is secured to the hub body 34 of the central hub 32 along edges of the central hub. In a certain embodiment, the support straps 36, 38 can be permanently secured to the hub body 34 of the central hub 32 as by stitching or the like. As shown, the support straps 36, 38 extend from the central hub 32 at an approximate 90° or so angle with respect to each other.

Each support strap 36, 38 is configured to be secured to the golf bag 10 adjacent at a middle of the golf bag at spaced apart locations on the golf bag. In one embodiment, each support strap 36, 38 further includes a free end having a connector. Specifically, the free end of support strap 36 includes a pivotal connector 40, which, as shown in FIG. 2, is configured to mate with the connector 26 of the golf bag 10 to releasably secure the support strap 36 to the middle of the golf bag. Similarly, the free end of support strap 38 includes a pivotal connector 42, which is configured to mate with connector 22 of the golf bag 10 to releasably secure the support strap 38 to the middle of the golf bag. Each support strap 36, 38 further includes an adjustable slide to adjust a length of the strap in the well-known manner. As shown, support strap 36 includes adjustable slide 44 and support strap 38 includes adjustable slide 46 to shorten and lengthen the lengths of the support straps to accommodate the body shape and size of the carrier. In one embodiment, the support straps 36, 38 can be fabricated from webbing strap material, such as 25 millimeter (mm) webbing strap material.

The central hub 32 further includes two articulated strap rings or connectors, e.g., D-rings, indicated at 48, 50, which are secured to the hub body 34 and provided to connect straps to the central hub along edges of the hub body generally opposite to the support straps 36, 38. The D-rings 48, 50 are permanently secured to the hub body 34 of the central hub 32 and configured to rotate with respect to the central hub along an axis that extends along a respective edge of the hub body. Although D-rings 48, 50 are shown and described herein, it should be understood that any type of connector can be used to secure the ends of the support straps 36, 38. For example, O-shaped, square-shaped or rectangular-shaped rings may be provided.

The D-rings 48, 50 are provided to connect to two relatively longer adjustable shoulder straps, indicated at 52, 54, respectively. The shoulder straps 52, 54 are much longer than support straps 36, 38, and are configured to be slung over the shoulders of the carrier during use. In the shown embodiment, each shoulder strap 52, 54 includes an end that is secured to its respective D-ring 48, 50 by stitching the end of the shoulder strap in a loop about the D-ring. As shown, the shoulder straps 52, 54 extend from the central hub 32 at an approximate 90° or greater angle with respect to each other. The arrangement is such that the support straps 36, 38 and the shoulder straps 52, 54 create a generally X-shaped configuration when extended from the central hub 32. This X-shaped configuration is shown in FIG. 3.

Each shoulder strap 52, 54 further includes a free end having a connector. Specifically, the free end of shoulder strap 52 includes a pivotal connector 56, which, as shown in FIG. 2, is configured to mate with the connector 24 of the golf bag 10 to releasably secure the shoulder strap 52 to the middle of the golf bag. Similarly, the free end of shoulder strap 54 includes a pivotal connector 58, which is configured to mate with connector 20 of the golf bag 10 to releasably secure the shoulder strap 54 to the middle of the golf bag. Each shoulder strap 52, 54 further includes an adjustable slide to adjust a length of the strap in the well-known manner. As shown, shoulder strap 52 includes adjustable slide 60 and shoulder strap 54 includes adjustable slide 62 to shorten and lengthen the lengths of the shoulder straps to further accommodate the body shape and size of the carrier. As with support straps 36, 38, the shoulder straps 52, 54 can be fabricated from webbing strap material, such as 25 mm webbing strap material.

Each shoulder strap 52, 54 further may include a shoulder pad secured to the webbing strap material to provide padding over the carrier's shoulders during use. As shown, shoulder strap 52 includes shoulder pad 64 and shoulder strap 54 includes shoulder pad 66. Each shoulder pad 64, 66 may be fabricated from any suitable cushioned material that can withstand the wear and tear of use. For example, the shoulder pads 64, 66 may be fabricated from foam material wrapped in ballistic-strength nylon. Each shoulder strap 52, 54 can be stitched to its respective shoulder pad 64, 66 along the length of the shoulder pad and include a daisy chain webbing technique, each indicated at 68, to provide further adjustment of the length of the shoulder strap. For example, two daisy chain webbings 68 are shown spaced apart approximately 15 centimeters (cm) on each shoulder strap 52, 54 when connected to their respective shoulder pad 64, 66. It should be understood that any number of daisy chain webbings can be provided along the length of the length of the shoulder pad 64, 66 at varying distances from one another.

The arrangement is such that the lengths of the support straps 36, 38 and the shoulder straps 52, 54 can be adjusted to fit the carrier. The adjustable slides 44, 46 associated with the support straps 36, 38 and the adjustable slides 60, 62 associated with the shoulder straps can be adjusted to adjust the lengths of the straps. The pivotal connections of the D-rings 48, 50 with respect to the hub body 34 of the central hub 32 enable the central hub to provide for balance optimization on the back of the carrier when carrying the golf bag 10. Specifically, when worn, with the shoulder straps 52, 54 of the shoulder strap system 30 over the carrier's shoulders, the central hub 32 is configured and arranged to be located generally in a center of the carrier's back.

Figure 4:
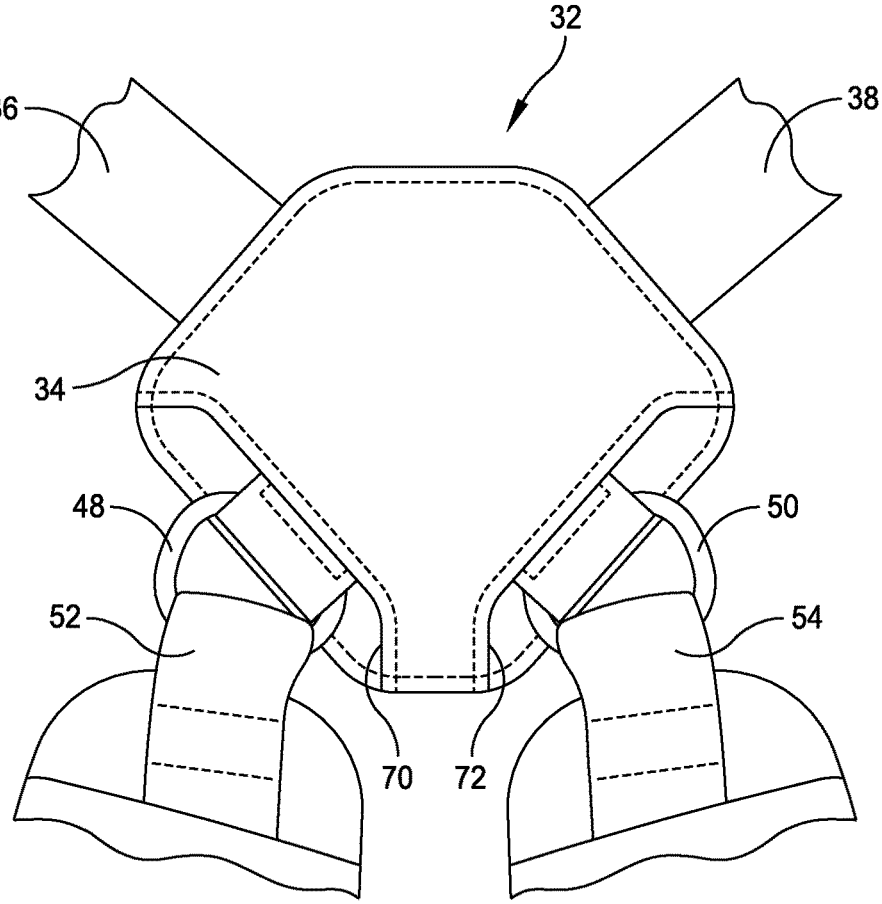
FIG. 4 is an enlarged front view of a portion of the shoulder strap system.
Figure 5:
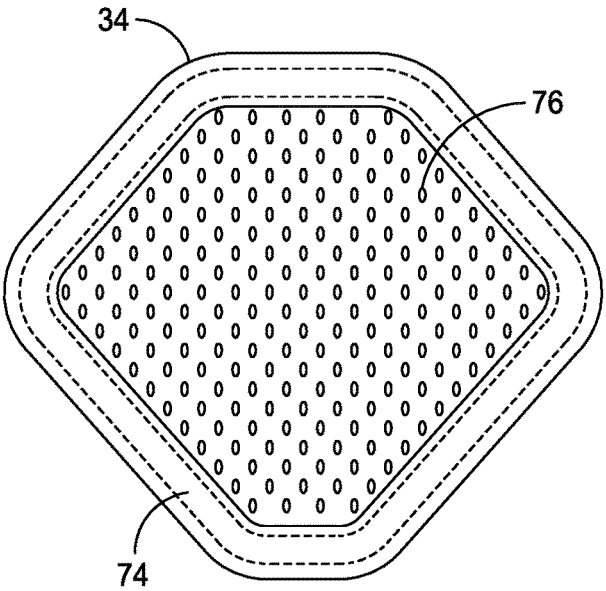
FIG. 5 is a front view showing a hub of the shoulder strap system.
Figure 6:
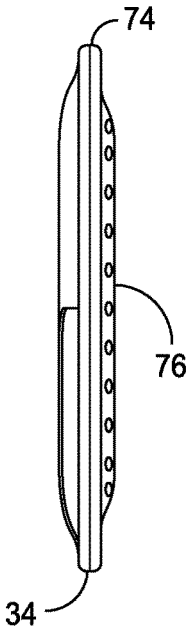
FIG. 6 is a side view of the hub.

Referring to FIGS. 4-6, the details of the central hub 32 are shown in greater detail. As shown in FIG. 4, the hub body 34 of the central hub 32 is configured with pockets or recesses, indicated at 70, 72, that are configured to receive the D-rings 48, 50, respectively. The D-rings 48, 50 are secured to the hub body 34 in a manner in which each D-ring 48, 50 is movable along an axis that is parallel to its respective edge of the hub body. Further, the hub body 34 of the central hub 32 may include a brand identifier applied to an outer surface of the hub body or stitched on the hub body.

Figure 7:
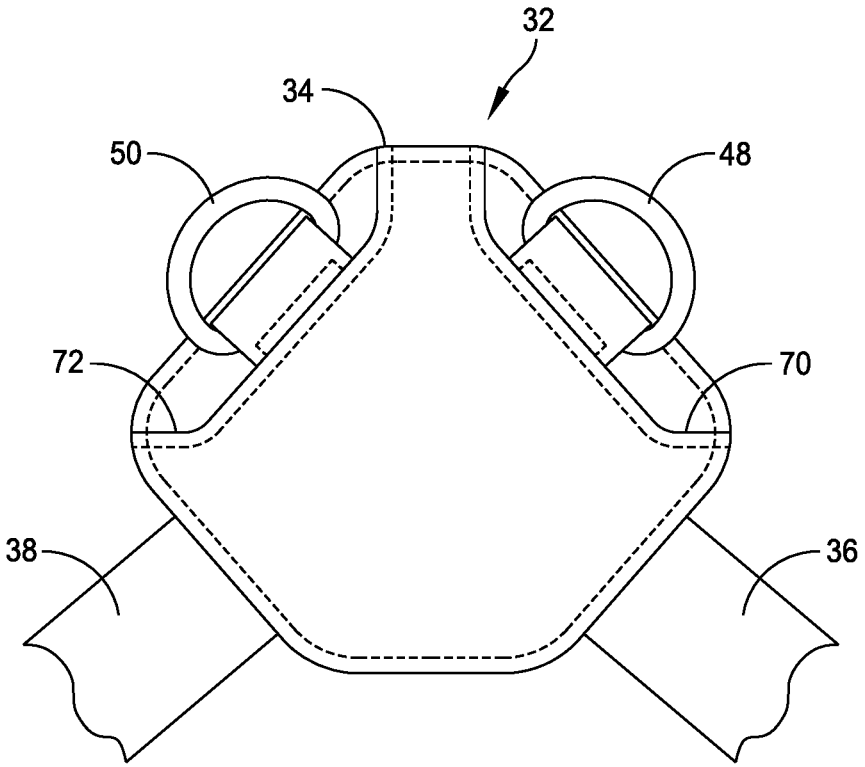
FIG. 7 is a front view of a portion of the shoulder strap system with straps removed to show hooks of secured to the hub.
Figure 8:
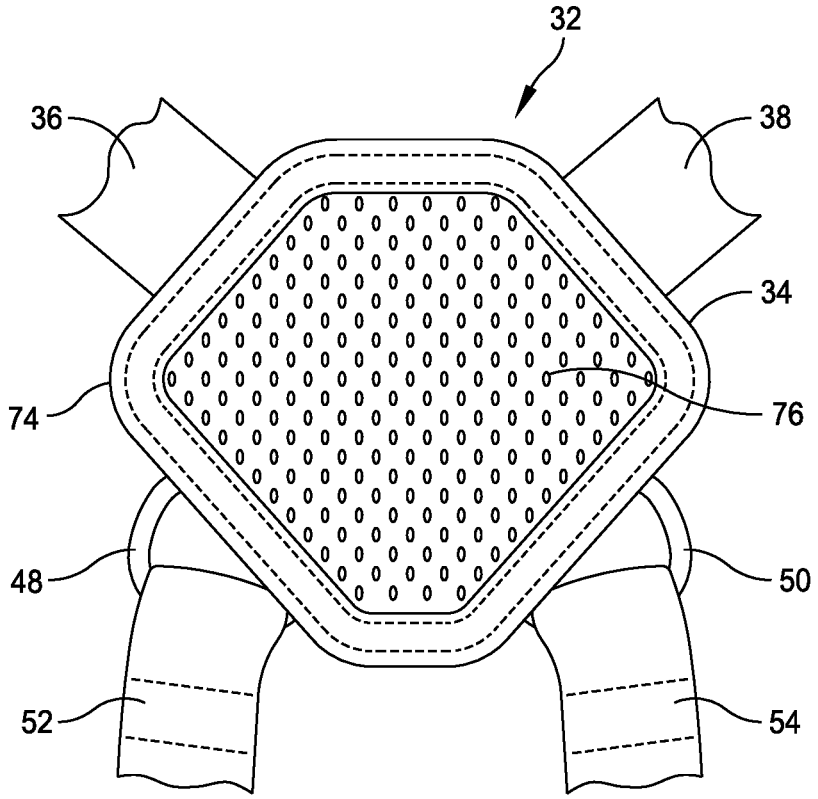
FIG. 8 is a back view of the portion of the shoulder strap system.

As shown in FIGS. 5 and 6, the hub body 34 of the central hub 32 can be configured to include an outer frame 74 that is connected to a padded inner portion 76. In one embodiment, the outer frame 74 of the hub body 34 can be fabricated from leather or any suitable rugged material and the inner portion 76 can be fabricated from a 3D padded mesh material, with the outer frame being stitched to the inner portion. The size and shape of the central hub 32 can include any number of design choices. In the shown embodiment the central hub 32 is 10.5 cm by 9.5 cm and 1 cm thick. FIGS. 7 and 8 illustrate embodiments of the central hub 32 without the shoulder straps 52, 54. The padded inner portion 72 of the central hub 32 provides padding and relative comfort against the carrier when carrying the golf bag 10.

Figure 9:
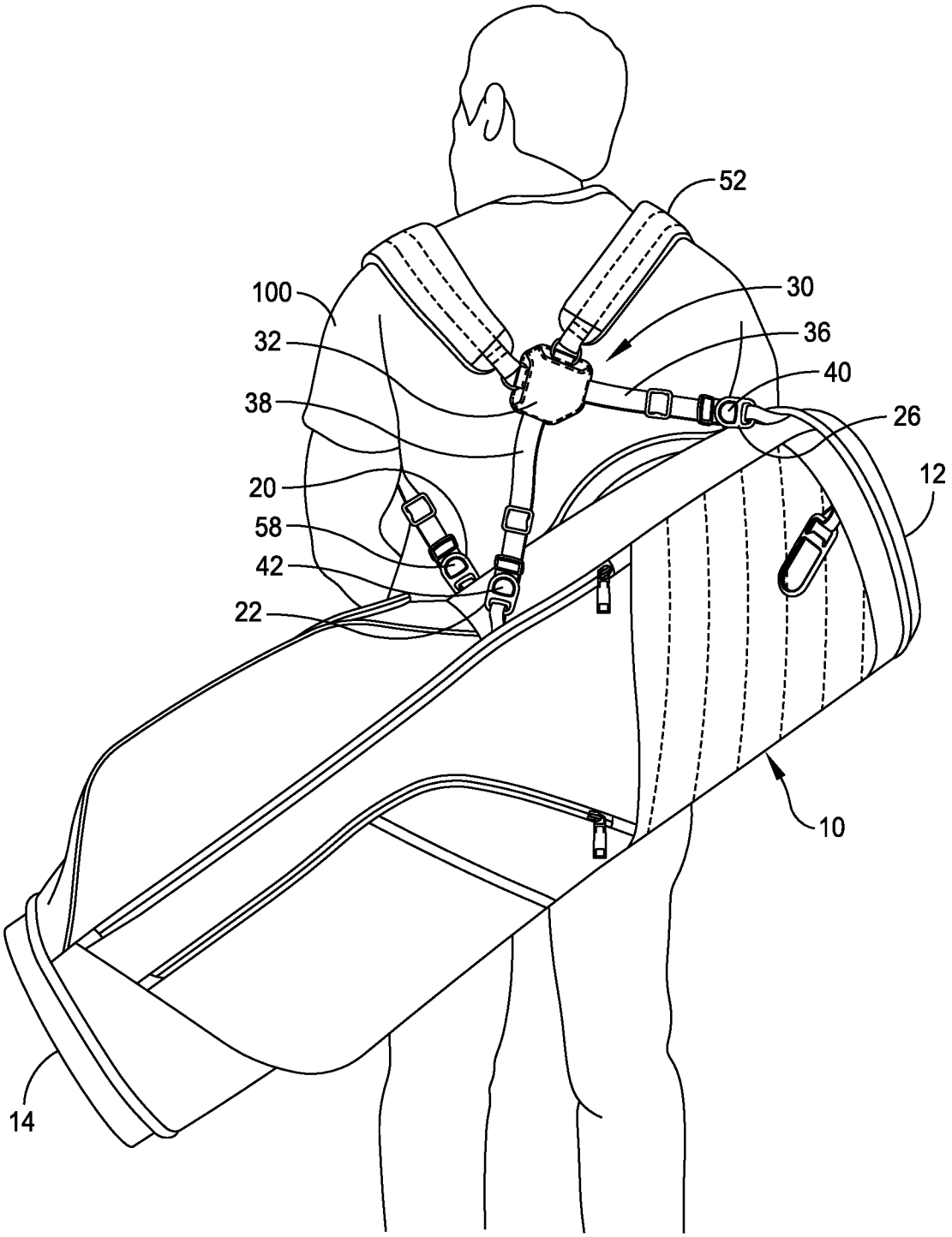
FIG. 9 is a perspective view of a person carrying a golf bag including a shoulder strap system of an embodiment of the present disclosure.

Referring to FIG. 9, a person 100 carrying golf bag 10 is shown with the golf bag extending so that the open end 12 is on the person's righthand side. This configuration is achieved by connecting the connectors 40, 42 of the support straps 36, 38 with the connectors 26, 22 of the golf bag 10, respectively, and by connecting the connectors 56, 58 of the shoulder straps 52, 54 with the connectors 24, 20 of the golf bag, respectively. To achieve a configuration in which the open end 12 of the golf bag 10 is on the person's lefthand side, the connectors 40, 42 of the support straps 36, 38 are connected to connectors 20, 24, respectively, and connectors 56, 58 of the shoulder straps 52, 54 are connected to connectors 22, 26, respectively.

FIG. 9 illustrates that the person carrying the golf bag 10 can easily adjust an angle of the golf bag by manipulating the shoulder straps 52, 54 on the person's shoulders. As shown, the length of shoulder strap 54 can be lengthened and/or the length of shoulder strap 52 shortened to raise the angle of the golf bag 10 so that the open end 12 of the golf bag is elevated. Also, the length of the shoulder strap 54 can be shortened and/or the length of the shoulder strap 52 lengthened to position the golf bag 10 in a generally horizontal position.

Moreover, the articulated connectors, e.g., connectors 26, 40, connectors 22, 42, connectors 24, 56 and connectors 20, 58, enable the ends of the support straps 36, 38 and the shoulder straps 52, 54, respectively, to pivot with respect to the golf bag 10. Further, the opposite ends of the shoulder straps 52, 54 are connected to the D-rings 48, 50 to enable the articulation of the shoulder straps with respect to the central hub 32. This structure enables the shoulder strap system 30 to accommodate carriers having different body types, including persons having broad or narrow shoulders.

It should be understood that the lengths of the support straps 36, 38 and the lengths of the shoulder straps 52, 54 can be varied depending on the person carrying the golf bag. For example, relatively shorter support straps 36, 38 and relatively shorter shoulder straps 52, 54 can be provided for a children's golf bag.

In some embodiments, the types of connectors can be varied depending on the cost and availability of such connectors.

In some embodiments, the shoulder straps 52, 54 are connected to the hub body 34 of the central hub 32 so that the shoulder straps are diagonally aligned with the opposing support straps 36, 38.

In some embodiments, the support straps 36, 38 are attached to the hub body 34 of the central hub 32 at an angle, preferably 90 degree angle to each other. In one embodiment, the support straps 36, 38 are fixedly and permanently attached preferably to the hub body of the central hub at fixed angle. Unlike the shoulder straps 52, 54, the support straps 36, 38 do not need to be articulated since the distance between the ends of the strap is fixed, i.e., the distance between the connectors 22, 26, and the lengths of the straps, although capable of being shortened or lengthened, can be set so that the 90 degree angle is achieved.

In some embodiments, the shoulder straps 52, 54 are attached to the hub body 34 of the central hub 32 at an angle, preferably a nominal 90 degree angle to each other, with each shoulder strap 52, 54 being pivotable about such a 90 degree angle.

In some embodiments, the support straps 36, 38 are attached to the hub body 34 of the central hub 32 at a bottom of the hub body and the shoulder straps 52, 54 are attached to the hub body of the central hub at a top of the hub body.

In some embodiments, the hub body 34 of the central hub 32 includes a geometric shape having two pairs of opposing sides parallel to which the support straps 36, 38 and the D-rings 48, 50 and the shoulder straps 52, 54 are attached, respectively.

Enumerated Embodiments

1. A golf bag strap support system (30) for supporting a golf bag (10), the strap support system (30) comprising:
   a central hub (32) including a hub body (34) and two articulated strap connectors (48, 50) secured to the hub body (34);
   two support straps (36, 48), each support strap (36, 38) including a first end and a second end, each first end of the support strap (36, 38) being configured to be secured to the golf bag, each second end of the support strap (36, 38) being secured to the hub body (34) of the central portion (32); and
   two shoulder straps (52, 54), each shoulder strap (52, 54) including a first end and a second end, each first end of the shoulder strap (52, 54) being configured to be secured to the golf bag, each second end of the shoulder strap (52, 54) being secured to a strap connector (48, 50) of the two articulated strap connectors (48, 50) of the central hub (32),
   wherein the two support straps (36, 38) and the two shoulder straps (54, 56) are configured with respect to the central hub (32) in a generally X-shaped configuration.
2. The strap support system (30) of claim 1, wherein the first end of each support strap (36, 38) is secured to the golf bag (10) at a middle of the golf bag (10), the first ends of the support straps (36, 38) being spaced from one another.
3. The strap support system (30) of claim 1 or 2, wherein the first end of each shoulder strap (52, 54) is secured to the golf bag (10) adjacent a top of the golf bag (10), the first ends of the shoulder straps (52, 54) being spaced from one another a distance similar to the spacing of the first ends of the support straps (36, 38).
4. The strap support system (30) of any preceding claim, wherein the first end of each support strap (36, 38) has a first part (40, 42) of a connector attached thereto for connecting with a second mating part (20, 22) of the connector attached to the golf bag (10).
5. The strap support system (30) of any preceding claim, wherein the first end of each shoulder strap (52, 54) has a first part (56, 58) of a connector attached thereto for connecting with a second mating part (24, 26) of the connector attached to the golf bag (10).
6. The strap support system (30) of claim 5, wherein each connector is a releasable snap-fit connector.
7. The strap support system (30) of claim 5 or 6, wherein the second mating parts (20, 22, 24, 26) of the connectors are disposed on the golf bag (10).
8. The strap support system (30) of claim 7, wherein two second mating parts (20, 22) of the connectors are disposed generally at a middle of the golf bag (10) and two second mating parts (24, 26) of the connectors are disposed towards a top of the golf bag (10).
9. The strap support system (30) of any preceding claim, wherein the second end of each shoulder strap (52, 54) is stitched in a loop and secures a D-ring (48, 50) of the two articulated strap connectors (48, 50).
10. The strap support system (30) of any preceding claim, wherein the hub body (34) of the central hub (32) includes a geometric shape having two pairs of opposing sides parallel to which the support straps and the strap rings and the shoulder straps are attached, respectively.

11. The strap support system (30) of claim 9, wherein the hub body (34) of the central hub (32) is planar.

12. The strap support system (30) of any preceding claim, wherein each shoulder strap (52, 54) has a padded portion (64, 66) that engages the shoulder region of a carrier.

13. The strap support system (30) of claim 12, wherein each shoulder strap (52, 54) is stitched to the padded portion (64, 66) along the length of the padded portion (64, 66) in a daisy chain webbing technique (68) to provide further adjustment of the length of the shoulder strap (52, 54).

14. The strap support system (30) of any preceding claim, wherein the hub body (34) of the central hub (32) includes a frame portion (74) and a padded portion (76) secured to the frame portion (74).

15. The strap support system (30) of any preceding claim, wherein the central hub (32) is configured and arranged to be located generally in a center of a golfer's back when carrying the golf bag (10) and the shoulder straps (52, 54) on both shoulders to provide for balance optimization on the back of the golfer when carrying the golf bag (10).

16. The strap support system (30) of any preceding claim, wherein the shoulder straps (52, 54) are connected to the hub body (34) of the central hub (32) so that the shoulder straps (52, 54) are diagonally aligned with opposing support straps (36, 38).

17. The strap support system (30) of any preceding claim, wherein the support straps (36, 38) are attached to the hub body (34) of the central hub (32) at an angle, preferably 90 degree angle to each other.

18. The strap support system (30) of any preceding claim, wherein the support straps (36, 38) are fixedly and permanently attached preferably to the hub body (34) of the central hub (32) at a fixed angle.

19. The strap support system (30) of any preceding claim, wherein the shoulder straps (52, 54) are attached to the hub body (34) of the central hub (32) at an angle, preferably a nominal 90 degree angle to each other, each shoulder strap (52, 54) being pivotable about such a 90 degree angle.

20. The strap support system (30) of any preceding claim, wherein the support straps (36, 38) are attached to the hub body (34) of the central hub (32) at a bottom of the hub body (32) and the shoulder straps (52, 54) are attached to the hub body (34) of the central hub (32) at a top of the hub body (32).

21. A golf bag (10) including the strap support system (30) of claims 1-20.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed:

1. A golf bag strap support system for supporting a golf bag, the strap support system comprising:

a central hub including a hub body and two articulated strap connectors secured to the hub body, the hub body including a geometric shape having a first side, a second side, a third side, a fourth side, and a fifth side disposed between the first side and the second side, the first side being diametrically opposite and parallel to the fourth side and the second side being diametrically opposite and parallel to the third side;

two support straps, each support strap including a first end and a second end, each first end of the support strap being configured to be secured to the golf bag, each second end of the support strap being secured to the hub body of the central hub, the second end of a first support strap of the two support straps being fixedly secured to the first side of the hub body and the second end of a second support strap of the two support straps being fixedly secured to the second side of the hub body; and two shoulder straps, each shoulder strap including a first end and a second end, each first end of the shoulder strap being configured to be secured to the golf bag, each second end of the shoulder strap being secured to a strap connector of the two articulated strap connectors of the central hub, the second end of a first shoulder strap of the two shoulder straps being secured to a first articulated strap connector of the two articulated strap connectors provided on the third side of the hub body of the central hub and the second end of a second shoulder strap of the two shoulder straps being secured to a second articulated strap connector of the two articulated strap connectors provided on the fourth side of the hub body, wherein the two support straps and the two shoulder straps are configured with respect to the central hub in a generally X-shaped configuration.

2. The strap support system of claim 1, wherein the first end of the first support strap of the two support straps is secured to the golf bag adjacent a top of the golf bag and the first end of the second support strap of the two support straps is secured to the golf bag at a middle of the golf bag, the first ends of the support straps being spaced from one another.

3. The strap support system of claim 2, wherein the first end of the first shoulder strap of the two shoulder straps is secured to the golf bag adjacent the top of the golf bag and the first end of the second shoulder strap of the two shoulder straps is secured to the golf bag at the middle of the golf bag, the first ends of the shoulder straps being spaced from one another a distance similar to the spacing of the first ends of the support straps.

4. The strap support system of claim 1, wherein the first end of each support strap has a first part of a connector attached thereto for connecting with a second mating part of the connector attached to the golf bag.

5. The strap support system of claim 4, wherein the first end of each shoulder strap has a first part of a connector attached thereto for connecting with a second mating part of the connector attached to the golf bag.

6. The strap support system of claim 5, wherein each connector is a releasable snap-fit connector.

7. The strap support system of claim 5, wherein the second mating parts of the connectors are pivotal and disposed on the golf bag.

8. The strap support system of claim 7, wherein two second mating parts of the connectors are disposed generally at a middle of the golf bag and two second mating parts of the connectors are disposed towards a top of the golf bag.

9. The strap support system of claim 1, wherein the second end of each shoulder strap is stitched in a loop and secures a D-ring of the two articulated strap connectors.

10. The strap support system of claim 1, wherein the hub body of the central hub is planar.

11. The strap support system of claim 1, wherein each shoulder strap has a padded portion that engages the shoulder region of a carrier.

12. The strap support system of claim 11, wherein each shoulder strap is stitched to the padded portion along the length of the padded portion in a daisy chain webbing technique to provide further adjustment of the length of the shoulder strap.

13. The strap support system of claim 1, wherein the hub body of the central hub includes a frame portion and a padded portion secured to the frame portion.

14. The strap support system of claim 1, wherein the central hub is configured and arranged to be located generally in a center of a golfer's back when carrying the golf bag and the shoulder straps on both shoulders to provide for balance optimization on the back of the golfer when carrying the golf bag.

15. The strap support system of claim 1, wherein the shoulder straps are connected to the hub body of the central hub so that the shoulder straps are diagonally aligned with opposing support straps.

16. The strap support system of claim 1, wherein the support straps are attached to the hub body of the central hub at an angle and at a 90 degree angle to each other.

17. The strap support system of claim 1, wherein the support straps are fixedly and permanently attached to the hub body of the central hub at a fixed angle.

18. The strap support system of claim 1, wherein the shoulder straps are attached to the hub body of the central hub at an angle and at a nominal 90 degree angle to each other, each shoulder strap being pivotable about such a 90 degree angle.

19. The strap support system of claim 1, wherein the support straps are attached to the hub body of the central hub at a bottom of the hub body and the shoulder straps are attached to the hub body of the central hub at a top of the hub body.

20. A golf bag including the strap support system of claim 1.

21. The strap support system of claim 1, wherein the hub body of the central hub further is configured with two pockets that are configured to receive the two articulated strap connectors, a first pocket of the two pockets being configured to receive the first articulated strap and a second pocket of the two pockets being configured to receive the second articulated strap.

* * * * *